US006126011A

United States Patent [19]

Ullmann et al.

[11] Patent Number: 6,126,011

[45] **Date of Patent: *Oct. 3, 2000**

[54] CASE FOR SMALL APPLIANCES

[75] Inventors: Roland Ullmann, Offenbach; Helmut Faulstich, Frankfurt, both of Germany

[73] Assignee: Braun Aktiengesellschaft, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,005

[22] Filed: Aug. 25, 1997

Related U.S. Application Data

[63] Continuation of application No. 08/637,794, filed as application No. PCT/EP94/03566, Oct. 29, 1994, abandoned.

[30] Foreign Application Priority Data

Nov. 15, 1993 [DE] Germany ..... 43 38 940

[51] Int. Cl.[7] ..... B65D 25/10; A45C 13/02; A45C 5/12

[52] U.S. Cl. ..... 206/576; 206/320; 206/351

[58] Field of Search ..... 206/0.83, 0.84, 206/38, 86, 92, 214, 223, 242, 362, 370, 372, 376, 379, 461, 472, 747–750, 759, 760, 576, 581

[56] References Cited

U.S. PATENT DOCUMENTS

| | | | |
|---|---|---|---|
| 1,101,310 | 8/1914 | Mendelson et al. | 206/769 |
| 1,587,178 | 6/1926 | Peterson | 206/92 |
| 1,876,493 | 9/1932 | Frutkow et al. | 206/231 |
| 2,087,056 | 7/1937 | Bowen | 206/86 |
| 2,094,322 | 9/1937 | Hannings | 206/235 |
| 2,321,462 | 6/1943 | Conant | 206/229 |
| 2,744,621 | 5/1956 | Kegevic | 206/234 |
| 2,804,969 | 9/1957 | Barnett . | |
| 3,240,324 | 3/1966 | Braun . | |
| 3,917,456 | 11/1975 | Eckstein et al. | 206/305 |
| 4,340,141 | 7/1982 | Fischer . | |
| 5,095,924 | 3/1992 | Stanfield . | |
| 5,242,055 | 9/1993 | Pora | 206/532 |

FOREIGN PATENT DOCUMENTS

| | | |
|---|---|---|
| NR 200739 | 11/1958 | Austria . |
| 1 074 098 | 10/1954 | France . |
| 1711122 | 9/1955 | Germany . |
| 78 17 067 | 11/1978 | Germany . |
| 79 00 213 U | 4/1979 | Germany . |
| 34 09 706 | 7/1985 | Germany . |
| 87 02 475 U | 4/1987 | Germany . |
| 88 07 052 U | 7/1988 | Germany . |
| 89 11 629 U | 11/1989 | Germany . |
| 90 03 219 U | 5/1990 | Germany . |
| 91 08 736 U | 9/1991 | Germany . |
| 90 16 955 U | 4/1992 | Germany . |
| 61-41482 | 2/1986 | Japan . |
| 63-30389 | 8/1988 | Japan . |

OTHER PUBLICATIONS

Copy of International Search Report dated Mar. 2, 1995.

*Primary Examiner*—Jim Foster
*Attorney, Agent, or Firm*—Fish & Richardson P.C.

[57] ABSTRACT

The invention is directed to a case for storing small appliances for personal use. The case (2) is comprised of a supporting structure (4) having at least two sections (8, 10) jointed to each other by a deflecting means (6). Provided on either section (8, 10) is at least one retaining means (12, 14) receiving an appliance and an accessory. Related to the deflecting means, the retaining means (12, 14) are so arranged that they lie side-by-side in a row when the sections (8, 10) are folded one over the other.

21 Claims, 6 Drawing Sheets

CASE FOR SMALL APPLIANCES

This is a continuation of application Ser. No. 08/637,794, filed May 6, 1996, now abandoned which is a 371 of PCT/94/03566 filed Oct. 29, 1994.

This invention relates to a case for small appliances.

The majority of small appliances are offered and operated with a plurality of accessories which are, in part, also voluminous. Shavers, for example, are sold with a cord or a power pack, with cleaning brushes and a variety of cutter attachments, and hair dryers are offered with a variety of nozzle attachments and line adapters. As a rule, these parts are stored in a case together with the main appliance so as to be readily available when needed.

The demand placed on such a case or pouch is in particular that the objects be stored in a space-saving manner. Accordingly, known pouches include a supporting structure subdivided into sections interconnected by deflecting means and foldable in a superimposed fashion along the deflecting means, with the supporting structure being closable, where applicable. A further requirement is that the various objects be stored in an orderly manner at predetermined locations in order to prevent the various objects from falling out of the pouch when it is opened.

The supporting structure may be configured as a flexible, planar structure, that is, as a soft pouch, or alternatively, as a rigid case, that is, as a hard-shell case.

A case of the type initially referred to is known from U.S. Pat. No. 3,240,324. The supporting structure of the case is subdivided into several sections jointed to each other by deflecting means. A first section, the bottom of the hard-shell case, has two receptacle means for receiving voluminous objects, such as a shaver and a transformer, while one or several further sections provide a cover for the first section by being adapted to pivot over the first section. These cover sections are customarily adapted to be linked to the first section by a releasable fastening device enabling the case to be closed.

For a space-saving configuration of the case, the shaver and the transformer are carried in a first section in a close side-by-side arrangement and are held in the receptacles configured as recessed portions. When it is desired to remove one object from the receptacle, the problem arises that a single object is difficult to grasp due to the close side-by-side arrangement. The removal of one object involves the inadvertent removal of the other object from its receptacle.

Folding cases like toiletry cases have an equally closely nested arrangement of implements. On the two insides of a case as known from U.S. Pat. No. 2,804,969, scissors, files, etc. are arranged closely adjacent to each other, resulting in two layers of implements superimposed with one another once the sides of the case are folded together. Cases of this type are unsuited for appliances such as shavers, dental care appliances, hair dryers and the like, because these appliances and their accessories are too voluminous to be stored in several superimposed layers.

German Utility Model No. DE-GM-90 16 955.7 U1 discloses a receptacle for receiving screwdrivers. The receptacle consists of two sections of a supporting structure molded in the manner of a shell and foldable one over the other by means of a hinge. All of the walls of the sections are provided with a plurality of holes for the purpose of positioning clamp holders for the screwdrivers at any desired location. The embodiment of FIGS. 7 and 8 of this printed specification shows that three screwdrivers each are attached to either of the shell-type sections by retention means, such that the voluminous handles of two screwdrivers are held directly adjacent to one another and thus cannot be readily removed by grasping the handles individually. If the two shell-type sections of this receptacle are placed in a superimposed relationship to one another, a two-layer receptacle results in which all of the voluminous objects received therein, such as the screwdrivers, are superimposed with one another in two rows—see FIG. 10.

From U.S. Pat. No. 5,095,924 it is known to subdivide a supporting structure of a case by means of a deflecting means into two superimposable sections and to provide either section with brackets distributed in any desired pattern for the holding of voluminous objects, such that these voluminous objects are held on either section by the brackets in a close side-by-side configuration. FIG. 2 of this printed specification shows a section with a tube of toothpaste held in place by several brackets, a razor in direct abutment with the tube of toothpaste and held in place by a bracket, and another bracket for receiving a bottle containing mouth-wash, equally in close proximity to the razor. Due to the close side-by-side arrangement of the objects to be received in their associated brackets, such as a tube of toothpaste, a razor, and a bottle of mouth-wash, none of these objects can be removed without interfering with neighboring objects, nor can any of the objects be removed from its associated bracket without interfering with at least one directly adjacent case wall. In addition, further equally voluminous objects, such as, for example, two toothbrushes, are arranged in close proximity to each other on the opposite second section of the case, and another bracket is provided for receiving yet another voluminous object. When the two shell-type sections of the case are folded shut, a two-layer case results in which the described objects are superimposed with each other in two rows.

Accordingly, it is an object of the present invention to provide a pouch configured to the smallest possible dimensions, in which the various objects to be stored are arranged such that each single object is freely removable.

This object is accomplished by a case having the the features of the invention.

According to the present invention, a variety of retaining means for holding the appliance and its accessory or accessories are arranged on various sections of the supporting structure. At least two adjacent sections jointed to each other by a deflecting means include at least one retaining means each. Related to the deflecting means, the at least two retaining means are so arranged that in superimposed condition the retaining means—and thus the appliances or accessories stored therein, in particular voluminous objects—are adapted to occupy positions adjacent to each other.

With the sections in superimposed condition, the appliance and its accessories will therefore occupy positions adjacent to each other.

The arrangement of the appliance and its accessory or accessories in different retaining means not only affords the advantage of allowing selected objects to be withdrawn singly, but also the arrangement of the retaining means on various sections of the supporting structure has the added advantage that the objects are at a wide relative spacing to each other with the pouch open, enabling a single object to be accessed for withdrawal without any interference.

This type of arrangement has proved to be surprisingly appropriate, although it may first appear impractical to use the cover of the pouch for the storage of objects. Arranging all objects in the bottom of the pouch requires all objects to be stored directly adjacent to each other or even in abutting engagement with each other both in the closed and the open condition of the pouch, in order to keep the pouch as small as possible. In the solution of the present invention, stowage of the various objects in the closed pouch is just as compact as in conventional pouches, yet in the open condition, these objects are widely spaced from each other, being consequently far more readily accessible. Overall, greater flexibility in the arrangement of the individual objects is afforded, enabling the arrangement to be optimized depending on the particular requirements of the appliance and its accessories.

For storing several objects, it is also possible to provide several retaining means on one or several sections of the supporting structure. These retaining means are then arranged such that they and any appliances or accessories held therein will occupy adjacent positions when the sections are in a superimposed configuration. In superimposed condition, the retaining means and, where applicable, the objects therein received of the first section of the supporting structure will therefore engage in the space between the retaining means of the second section, resulting again in a single row in which all objects are arranged side-by-side.

It occurs frequently that not only various voluminous objects but also accessories of a particularly flat shape need to be stored. To keep the size of the pouch at a minimum, it is therefore possible to provide respective retaining means for at least two such flat objects on adjacent sections of the supporting structure, which retaining means are at the same relative distance to the deflecting means. With the pouch folded together, these two flat objects will then be superimposed with each other, without however exceeding the thickness of the thickest appliance or accessory.

In its simplest form, the present invention comprises a supporting structure having at least two sections jointed to each other along a deflecting means, with each section including at least one retaining means either for a voluminous appliance or for an accessory. Preferably, the sections of the supporting structure are adapted to be connected with each other by a fastening device. Such a device is arranged, for example, on one side of a section, to be fastened to the other section as a press fastener as, for example, in the manner of a snap-on or Velcro-type fastener. However, the two sections may also be fastened to each other by a zipper provided on the outer edges of the supporting structure or by a latch lock, in which case a respective latch member is disposed on either section.

To improve the covering for the appliances and accessories to be stored, the pouch may be provided with end walls extending between the bottom wall and the cover, that is, between the two sections of the supporting structure.

In a further embodiment of the case or pouch of the present invention, the supporting structure includes three sections jointed together in series by respective deflecting means and having at least one retaining means each. The pouch is folded together in such a manner that the two end sections of the supporting structure are folded over the center section. In this embodiment, one end section overlaps the center section only in part, the center section being completely covered only after both end sections are folded over. The retaining means are arranged on the three sections such that in superimposed condition the retaining means and any objects stored therein will be in a side-by-side arrangement.

In an advantageous embodiment of the present invention, one of the end sections of the supporting structure includes a fastening device which overlaps at least in part another end section when folded together and is adapted to be releasably secured thereto as, for example, in the manner of a snap-on or Velcro-type fastener.

The retaining means for the appliance and its accessories may be configured in accordance with the demands made on the case. As snap-on clamps disposed in pairs, for example, they may be arranged so as to partially embrace the object to be stored, thereby permitting free access to the object. A retaining function may also be performed by receptacle-like rigid components configured in trough shape, for example. Flexible straps comprised of one or several parts are also suitable as retaining means. Where multi-part straps are utilized, these are advantageously adapted to be connected with each other using, for example, a press or Velcro-type fastener. Depending on their intended use, the retaining means are fixedly or releasably secured to the supporting structure.

A deflecting means as used herein is understood to be a straight line which in its simplest form is merely an imaginary line between the two sections of the supporting structure. It will be understood, however, that it may also be configured as a folding line scored in a prior operation, or as a joint or hinge or, where applicable, also as a transmission means.

Where particularly voluminous appliances or accessories are involved, the deflecting means may be extended to cover a deflecting area bounded by two lines, so that the sections of the supporting structure are at a greater relative spacing when in a superimposed configuration. In a preferred embodiment of the present invention, the two lines bounding the deflecting area are configured as a hinge.

In a particularly preferred embodiment of the folding pouch, one retaining means is arranged on a section of the supporting structure immediately adjoining the deflecting means, so that it rests against the pouch wall surfaces immediately adjacent to the deflecting means when the pouch is closed. According to a particularly advantageous feature of this embodiment of the present invention, the retaining means is configured such as to be of a predetermined shape as, for example, a rounded shape having a substantial portion of its circumference in abutting engagement with the supporting structure when the pouch is closed. By this means, the usually rounded end area of the pouch is used to advantage. In addition, a good weight distribution in the pouch will result when a heavy accessory is held in this retaining means disposed close to the deflecting means.

When the pouch has a deflecting area of some width, the utilization of the inner space of the pouch is improved by arranging a retaining means, which in this event may also be of a rectangular cross-section, directly close to a deflecting means bounding the deflecting area.

The present invention will now be illustrated and described with reference to some embodiments. In the drawings, FIG. 1 is a sectional view of a soft pouch for a shaver showing the retaining means for the appliance and the cord;

FIG. 1*a* is a sectional view of a soft pouch having three retaining means;

FIG. 1*b* is a sectional view of a soft pouch having four retaining means;

Figure 1:
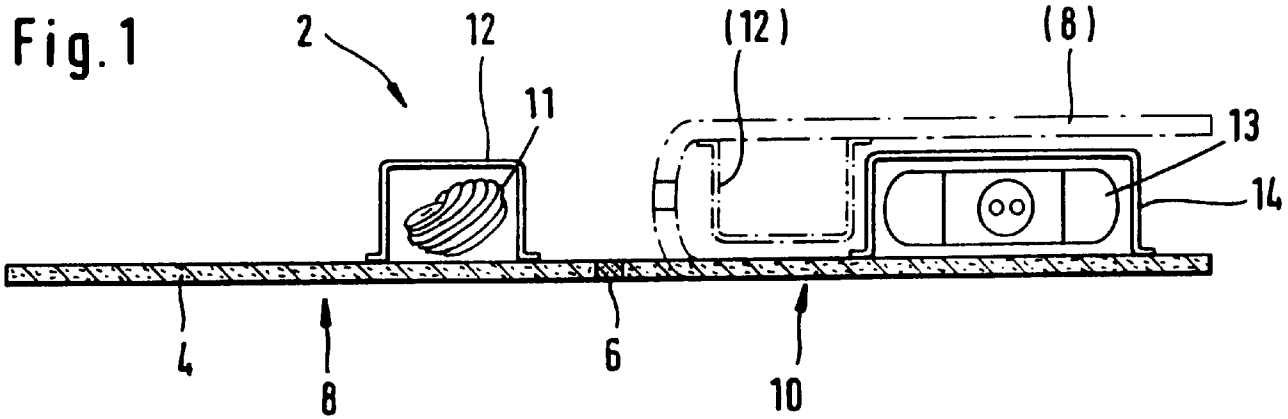

Referring now to FIG. 1 of the drawings, there is shown a case 2 for a shaver which includes the features essential to the present invention. A flexible, planar supporting structure 4 made, for example, of leather, imitation leather or a fabric is subdivided into two sections 8 and 10 by a line 6 scored in the material of the supporting structure 4. By means of the line scored in the material, a deflecting means 6 is formed, enabling the two sections 8 and 10 to be folded one over the other along the scored line as shown in broken lines.

A retaining means is provided on each section 8, 10; while the retaining means 12 on section 8 is intended to hold the cord 11 of the shaver 13, the retaining means 14 on section 10 is intended for the shaver 12. The retaining means 12 and 14 are single lengths of flexible straps fixedly secured to the supporting structure by adhesive bonding or sewing. Their dimensions are conformed to the object they are intended to hold.

The retaining means 12 is at such a relative distance to the deflecting means 6 that it will occupy a position adjacent to the retaining means 14 when section 8 is folded over section 10. The retaining means 14 being at a greater relative distance to the deflecting means 6, the retaining means 12 is in a position to extend into the space between the retaining means 14 and the deflecting means 6 when the sections 8 and 10 are in a superimposed configuration. In this closed condition, the free end of section 8 will overlap the retaining means 14.

Figure 2:
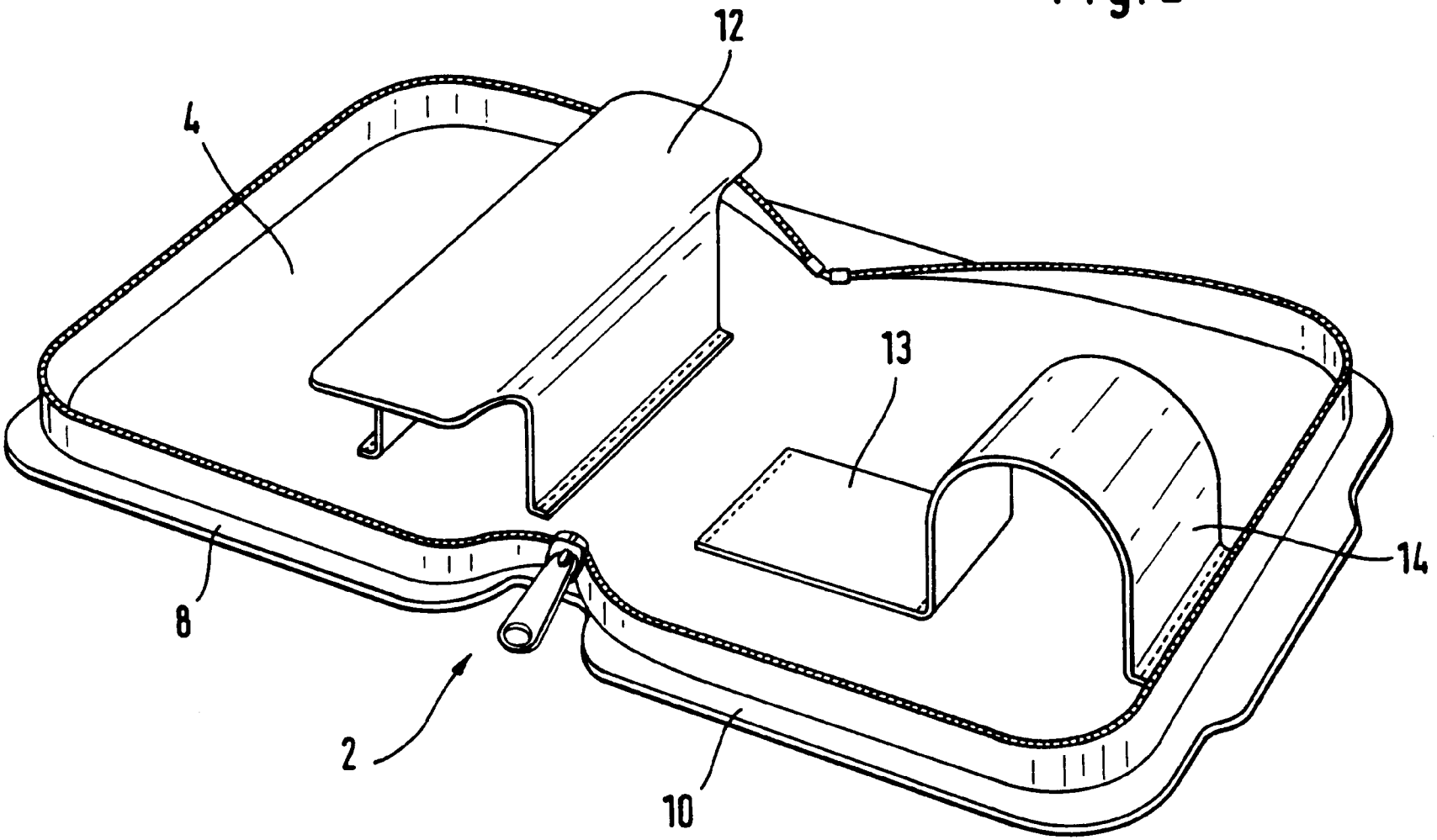
FIG. 2 is a view of a soft pouch.

In the closed condition, the retaining means and the objects they hold lie directly side-by-side, the relative distance of the two sections 8 and 10 being then determined by the thickest part, which in this arrangement is the shaver. In the open condition, the retaining means configured as straps are at a wide relative spacing, enabling the shaver and the cord to be withdrawn singly without interference. The straps may be configured as narrow ribbons or as wide bands covering the object to be received almost completely. In this connection, fastening a third side of a strap to the supporting structure so as to produce a pocket may also be contemplated. FIG. 2 shows a soft pouch providing, in addition to the retaining means configured as straps 12 and 14, a further retaining means 13 configured as a strap for holding a flat accessory on the side close to the retaining means 12. With the pouch closed, the straps 12 and 13 are superimposed with one another.

Figure 1A:
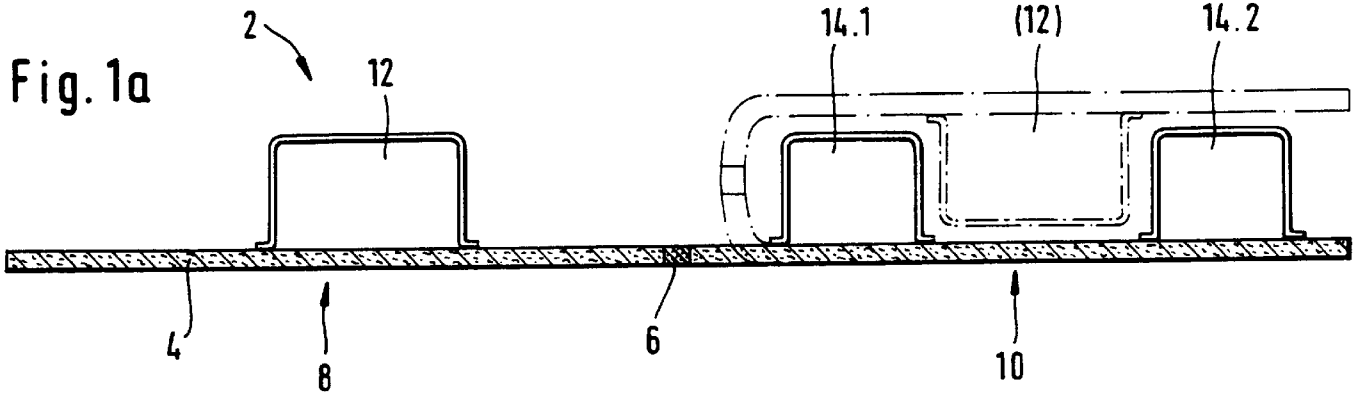
Figure 1B:
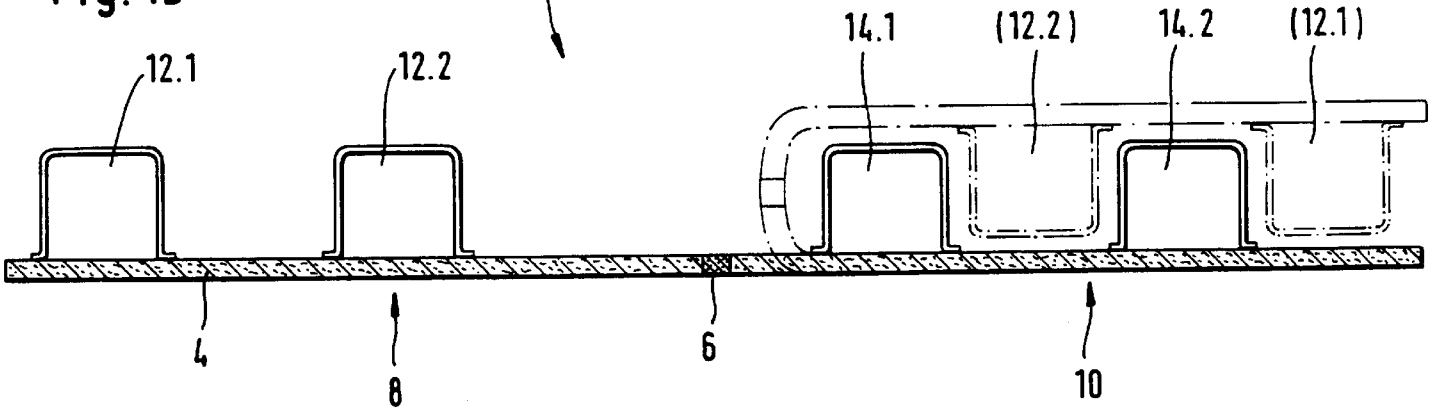

In a further development of the arrangement of two retaining means within a case as explained with reference to FIG. 1, FIGS. 1*a* and 1*b* show each, by way of example, a further preferred embodiment of the arrangement of retaining means, taking into consideration a space-saving disposition ensuring at the same time ease of withdrawal of the objects stored in the retaining means. In the embodiment of a case 2 as shown in FIG. 1*a,* a total of three retaining means 12, 14.1 and 14.2 are fastened to the supporting structure 4 subdivided into two sections 8 and 10 by a deflecting means 6. On section 10, two retaining means 14.1 and 14.2 are arranged at a predetermined relative distance, this distance being determined by the width of the retaining means 12 disposed on section 8. The location of the retaining means 12 disposed on section 8 is such that the retaining means 12 fits into the space between the retaining means 14.1 and 14.2 when section 8 is folded over section 10, the two sections then extending parallel to each other.

In the embodiment of FIG. 1*b,* two retaining means 12.1 and 12.2 are secured to section 8 and two retaining means 14.1 and 14.2 are secured to section 10, such that when sections 8 and 10 are superimposed with one another the retaining means 12.1, 12.2 of section 8 will be separated by one of the retaining means 14.1, 14.2 of section 10. This results in a nested arrangement of the retaining means 14.1, 12.2, 14.2 and 12.1 which come to lie in a side-by-side arrangement in a row, as shown in FIG. 1*b* by way of example.

Figure 3:
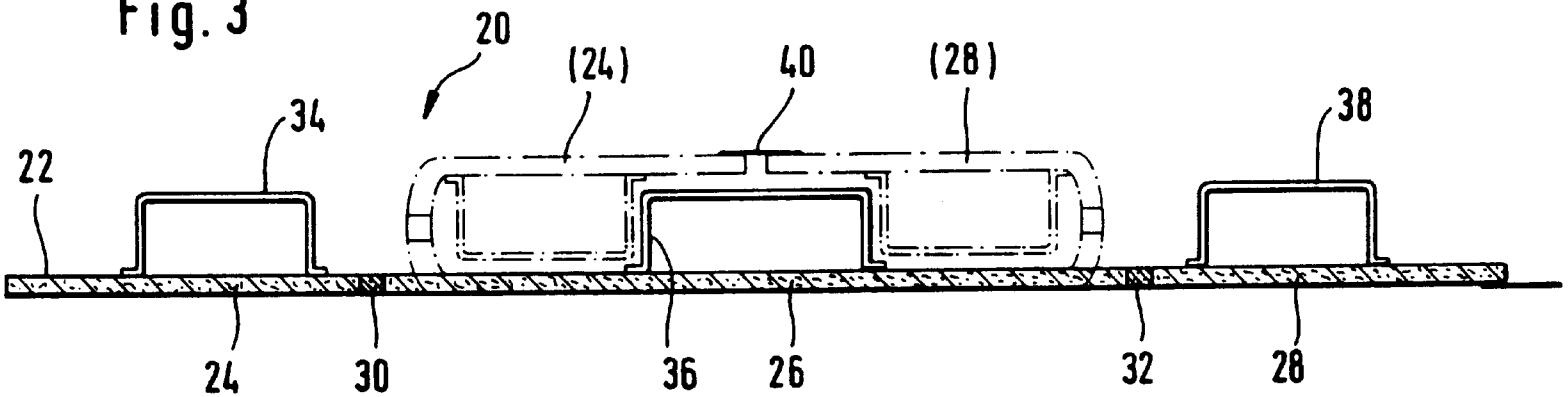
FIG. 3 is a sectional view of a soft pouch for a shaver, illustrating a second embodiment including three retaining means.

FIG. 3 shows a further embodiment of the present invention. The soft-shell pouch 20 is comprised of a supporting structure 22 subdivided into three serially arranged sections 24, 26 and 28. Sections 24 and 26 are interconnected by the deflecting means 30, while sections 26 and 28 and interconnected by the deflecting means 32. Along the deflecting means formed by score lines, the end sections 24 and 28 are foldable in the direction of the center over the center section 26, as shown in broken lines.

A retaining means configured as a strap is secured to each of the sections 24, 26 and 28. The retaining means serve likewise a retaining function for a shaver, a cord and a brush for cleaning the shaver (these objects being not shown). The retaining means 34 on section 24 is arranged in such a manner that it will come to lie adjacent to the retaining means 36 on section 26 when section 24 is folded over section 26. The retaining means 38 on section 28 is arranged in such a manner that it will come to lie adjacent to the retaining means 36 when section 28 is folded over section 26, the retaining means 36 being then in the middle between the two retaining means 34 and 38.

Thus, also in this embodiment all of the retaining means and any appliances or accessories they hold will be arranged side-by-side in a row when the pouch is closed. By contrast, with the pouch open, the retaining means 34, 36 and 38 are at a wide relative spacing, enabling each individual object therein contained to be withdrawn singly without interference.

When the pouch 20 is closed, the sections 24 and 28 will overlie the section 26 only in part. Lying over the retaining means 36, the ends of the sections 24 and 28 will point towards each other. To prevent the pouch 20 from opening accidentally, a flap 40 is formed on the end section 28, which flap overlies the end section 24 when the pouch 20 is closed and is secured thereto by means of a press fastener.

Figure 4:
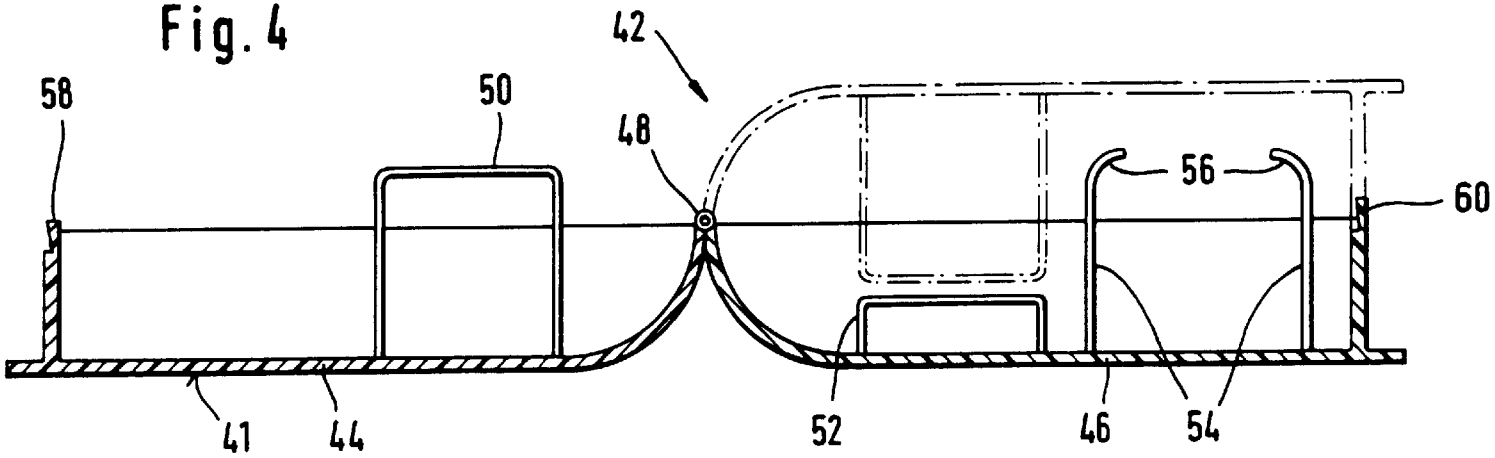
FIG. 4 is a sectional view of a hard-shell case for a shaver including retaining means for the appliance, the brush and the cord, in accordance with a further embodiment of the present invention.

FIG. 4 shows a hard-shell case 42 in which the supporting structure 41 is subdivided into two sections 44 and 46 forming shells and jointed to each other by means of a hinge 48. Secured to the shell 44 is a retaining means 50 configured as a strap, and shell 46 accommodates a retaining means 52 configured as a flat strap for holding a flat accessory as a brush, as well as rigid snap-on clamps having their upper ends 56 bent towards each other and serving as retaining means 54 for the shaver. The retaining means 52 in the shell 46 is at the same relative distance to the deflecting means 48 as the retaining means 50 in the shell 44. The snap-on clamps of the retaining means 54 are at a greater relative distance to the deflecting means 48 than the retaining means 52. The retaining means 50 and 52 and the snap-on clamps of the retaining means 54 are fixedly connected with the hard-shell case 42. In contrast to the straps, the snap-on clamps are rigid, yet they can be bent apart a small amount for inserting or withdrawing the shaver into or from the case 42. The retaining means 50 is of a lower height than the snap-on clamps of the retaining means 54, and the retaining means 52 is of a lower height than the strap forming the retaining means 50.

When the case 42 is closed, the retaining means 50 and 52 are in a superimposed configuration. The retaining means 50 and 52 are dimensioned such that with the case 42 closed their height in superimposed condition does not exceed the height of the snap-on clamps forming the retaining means 54. Owing to this compact arrangement, the space requirements of the case are maintained low, while yet providing ready access to the individual objects when the case is open because of their relative spacing. The case 42 is held in the closed position by latch members 58 and 60. The latch member 58 is formed integral with the end of the shell 44 remote from the hinge forming the deflecting means 48, while the latch member 60 is disposed at the end of the shell 46 remote from the hinge of the deflecting means 48. The case 42 is opened by separating the two latch members 58 and 60 from each other by the application of pressure and by pivoting the shells 44 and 46 by 90 degrees each, so they will lie in the same plane. As this occurs, the retaining means 50 will be moved away from the retaining means 52 and the retaining means 54, enabling the individual objects held within the straps or snap-on clamps of this retaining means to be readily withdrawn from the case singly.

Figure 5:
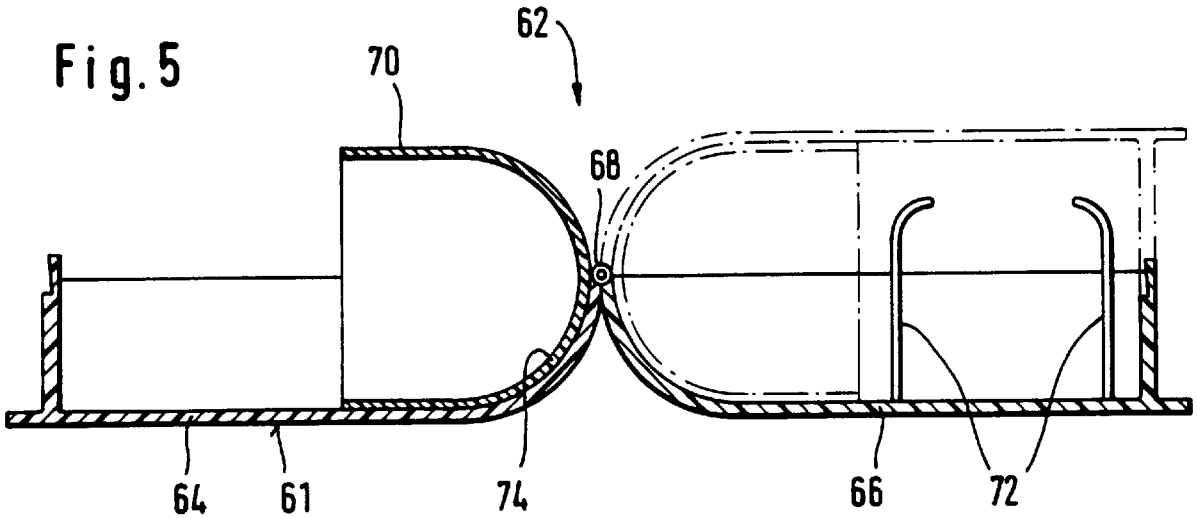
FIG. 5 is a sectional view of a hard-shell case for a shaver including retaining means for the appliance and the cord, in accordance with a preferred embodiment of the present invention.

FIG. 5 shows a preferred embodiment of a hard-shell case 62 in which the supporting structure 61 is likewise comprised of two sections 64 and 66 forming shells jointed to each other by a deflecting means 68 configured as a hinge. Secured within the shell 64 is a rigid, trough-shaped receptacle serving as a retaining means 70 for a shaver accessory, while the shell 66 provides a retaining means 72 in the form of snap-on clamps for holding a shaver. The retaining means 70 is provided in the area of the shell 64 immediately adjoining the deflecting means 68. With the case open, the trough-shaped receptacle is open at the end remote from the hinge 68, allowing ready removal of the shaver cord. The snap-on clamps forming the retaining means 72 are at such a relative distance to the deflecting means 68 that the trough-shaped receptacle will be received in the space between the retaining means 72 and the deflecting means 68 when the case is in closed condition.

With the case 62 closed, the retaining means 70 arranged in the immediate vicinity of the deflecting means 68 has its entire outer surface in engagement with the shells 64 and 66. As a result of this arrangement of the retaining means, the space in the interior of the case 62 is put to full use in an optimum manner.

The case of FIG. 5 has the added advantage that its optimally utilized interior space enables it to be dimensioned still smaller than the hard-shell case of FIG. 4. The embodiment of the case of the present invention as illustrated in FIG. 5 is therefore an optimized embodiment of the case, with the selection of the embodiment of the case being determined by the objects to be stored in the case.

Figure 6:
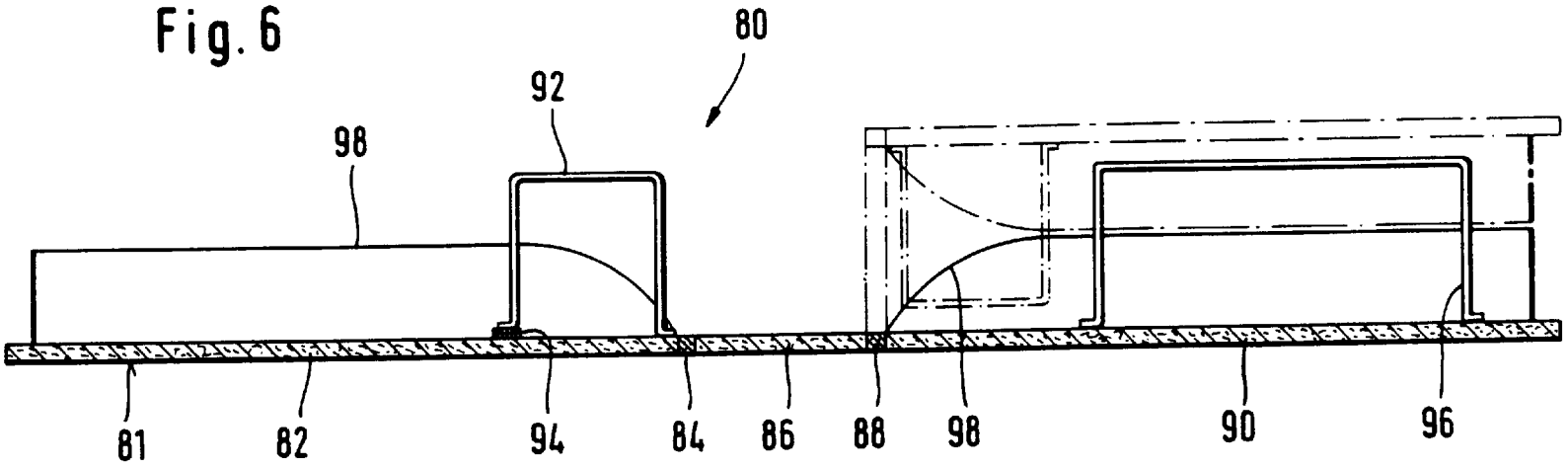
FIG. 6 is a sectional view of a soft pouch in accordance with a further preferred embodiment of the present invention.

An application of this rule is shown in FIG. 6. A supporting structure 81 of a soft pouch 80 is comprised of three parts, of which a first section 82 is jointed to a section 86 acting as a deflecting area by means of a deflecting means 84 formed by a score line. A further deflecting means 88 through which a second section 90 is jointed is formed at the other end of the section 86 by means of a score line extending parallel to the score line referred to above.

In the immediate vicinity of the deflecting means 84, a first retaining means 92 in the form of a strap is secured to the first section 82 of the supporting structure so as to be partially releasable, which is accomplished by an edge 94 being fastened to the first section 82 by means of a press or Velcro-type fastener. A second retaining means 96 in the form of a strap is secured to the second section 90 at such a relative distance to the second deflecting means 88 that the retaining means 92 and 96 will lie side-by-side when the sections 92 and 90 are superimposed with one another.

To close the pouch, a zipper 98 is provided on the outer edges of the supporting structure to connect the two sections 82 and 90.

Figure 7:
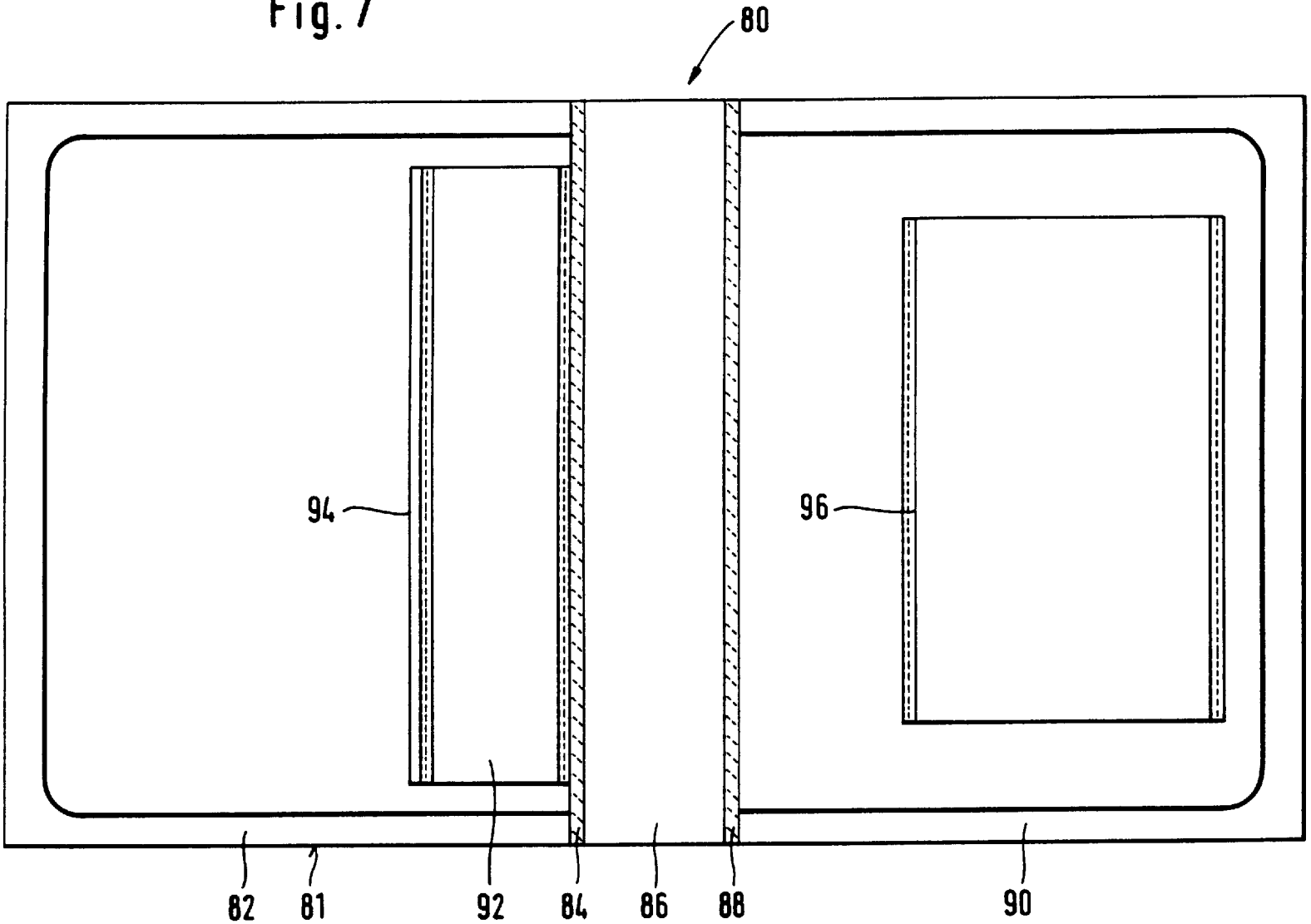
FIG. 7 is a top plan view of the pouch of FIG. 6.

With the pouch 80 closed, the section 86 extends normal to the two sections 82 and 90. In this position, the releasable retaining means 92 will occupy a position immediately adjoining the section 86. FIG. 7 shows the pouch of FIG. 6 in a top plan view. It becomes particularly clear from this illustration that in the open condition of the pouch the two straps providing the retaining means are at a wide relative spacing, thus affording ease of access.

Figure 8:
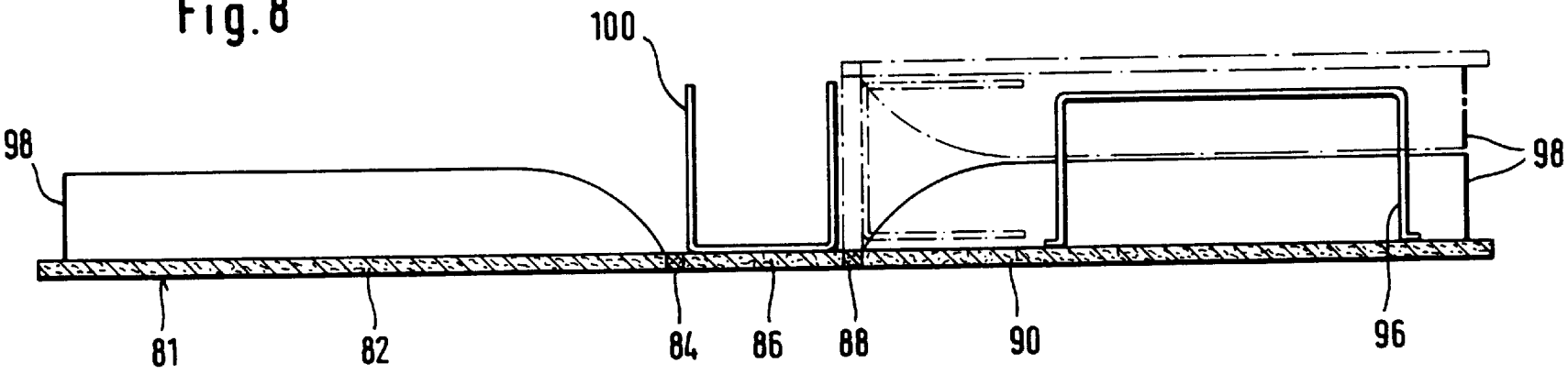
FIG. 8 is a sectional view of a hard-shell case in accordance with an advantageous embodiment of the present invention.

Unlike the embodiment of FIGS. 6 and 7, a strap or retaining means 92 may be provided in the section 86 as illustrated in FIG. 8 by way of example. A pouch having a strap or retaining means 100 in the deflecting area is especially suitable in cases where the strap or retaining means is of a rigid configuration. It proves to be particularly advantageous that this rigid retaining means is upwardly open with the pouch open, thus affording particular ease of access. It will be understood that it is within the scope of the present invention to arrange two or more retaining means on the supporting structure in a wide variety of ways.

What is claimed is:

1. A case and contents thereof comprising:

a first object which is an electric personal care appliance;

a second object which is a sower supplying element which during use delivers power to the appliance;

a supporting structure made of a first flexible material;

a hinge portion subdividing the supporting structure into a first section and a second section, wherein when the case is in a fully open condition, the first and second sections lie next to each other in a common plane with the hinge portion between them and when the case is in a fully closed position, the first and second said sections lie superimposed on one another, thereby forming a closed case;

a first retaining structure provided on the first section and which holds the first object onto the first section and oriented parallel to the hinge portion; and a second retaining structure provided on the second section and which holds the second object onto the second section and oriented parallel to the hinge portion, wherein said first and second retaining structures are arranged on the supporting structure so that the first and second objects lie in a single layer and separated by the hinge portion when the case is fully open and lie immediately adjacent to one another in said single layer when the case is fully closed, with the second object located between the first object and the hinge portion, and with the separation of the first section from the second section being substantially equal to the thickness of the first object, wherein when the case is in the fully open condition both first and second retaining means face in a first direction and in the fully closed condition the first and second retaining means face in opposite directions to each other, and wherein the first and second retaining structures are both made of flexible materials which are fixedly attached respectively to the first and second sections of the support structure so as to define openings through which during use the corresponding first and second objects are inserted into and withdrawn at will from held positions defined by the said first and second retaining structures, respectively.

2. The case as claimed in claim 1 further comprising a third retaining structure provided on the first section for holding a third object, said first and third retaining structures being arranged on the first section at a relative distance to each other, said second retaining structure arranged on said second section so that the second object lies in the space between the first and third retaining structures when the case is fully closed.

3. The case as claimed in claim 2 further comprising a fourth retaining structure provided on the second section for holding a fourth object, said first, second, third, and fourth objects lying side-by-side in said single layer when the case is fully closed.

4. The case as claimed in claim 1 further comprising a third retaining structure provided on the first section for holding a flat object, said flat object superimposed on the second object when the case is fully closed.

5. The case as claimed in claim 1 further comprising a third section and a second hinge portion connecting the third section to the second section.

6. The case as claimed in claim 1 wherein the first retaining structure holds the first object onto the first section at a location on the supporting structure which is devoid of any openings.

7. The case as claimed in claim 6 further comprising a device for releasably securing the first and second sections of the supporting structure when the case is fully closed.

8. The case as claimed in claim 7 wherein the device for securing the first and second sections is a zipper provided on outer edges of the supporting structure.

9. The case as claimed in claim 7 wherein the device for securing the first and second sections comprises a flap jointed to the supporting structure and a press fastener enabling the flap to be secured to the outside of the second section.

10. The case as claimed in claim 6 wherein the first retaining structure includes flexible straps.

11. The case as claimed in claim 10 wherein the straps are made of two parts which are adapted to be connected together by a press or Velcro-type fastener.

12. The case as claimed in claim 10 wherein the first retaining structure is releasably secured to the supporting structure.

13. The case as claimed in claim 1 wherein the supporting structure is made of a flexible soft planar material causing the case to be a soft pouch.

14. The case as claimed in claim 6 wherein the hinge portion is an imaginary line.

15. The case as claimed in claim 1 wherein the hinge portion is a line scored in the material of the supporting structure.

16. The case as claimed in claim 6 wherein the hinge portion is a hinge joint.

17. The case as claimed in claim 1 wherein the hinge portion is formed by a region of the supporting structure and by two lines or joints bounding the region.

18. The case as claimed in claim 5 further comprising a third retaining structure provided on the third section for holding a third object, said first section superimposed on said second section by pivoting about the first hinge portion, said third section superimposed on said second section by pivoting about the second hinge portion, and said first, second, and third objects lying side-by-side in said single layer when the case is fully closed.

19. The case as claimed in claim 1 wherein the electric personal care appliance is an electric shaver.

20. The case as claimed in claim 1 wherein the power supplying element is an electric power cord.

21. The case as claimed in claim 19 wherein the power supplying element is an electric power cord.

* * * * *